United States Patent [19]

Congleton

[11] 4,046,256

[45] * Sept. 6, 1977

[54] CONTAINER CONSTRUCTION

[75] Inventor: Wayne L. Congleton, Whittier, Calif.

[73] Assignee: Dolco Packaging Corporation, Burbank, Calif.

[ * ] Notice: The portion of the term of this patent subsequent to Sept. 10, 1991, has been disclaimed.

[21] Appl. No.: 627,321

[22] Filed: Oct. 30, 1975

Related U.S. Application Data

[63] Continuation of Ser. No. 434,179, Jan. 17, 1974, abandoned.

[51] Int. Cl.[2] ..... B65D 65/02; B65D 21/00

[52] U.S. Cl. ..... 206/497

[58] Field of Search ..... 206/72, 45.33, 497, 206/491, 503, 526; 229/32, 30, 2.5, DIG. 12; 217/65

[56] References Cited

U.S. PATENT DOCUMENTS

| | | | |
|---|---|---|---|
| 2,979,250 | 4/1961 | Hobbs | 229/32 |
| 3,347,365 | 10/1967 | Funkhouser | 206/497 |
| 3,675,808 | 7/1972 | Brink | 229/30 |
| 3,759,600 | 9/1973 | MacDonald | 217/65 |
| 3,868,054 | 2/1975 | Congleton | 229/2.5 |

*Primary Examiner*—William T. Dixson, Jr.
*Attorney, Agent, or Firm*—Nilsson, Robbins, Dalgarn & Berliner

[57] ABSTRACT

An improved container construction, particularly useful for arranging and securing a plurality of separable items therein. The unassembled container has a generally planar configuration and contains a bottom wall defining a floor upon which the items to be packaged are placed. The container includes side walls which are connected to adjacent floor edges by hinge lines. Shoulder members are formed on the floor and surfaces of the side walls adjacent each hinge line, and serve to define closure limits for the side walls when the container is assembled.

9 Claims, 7 Drawing Figures

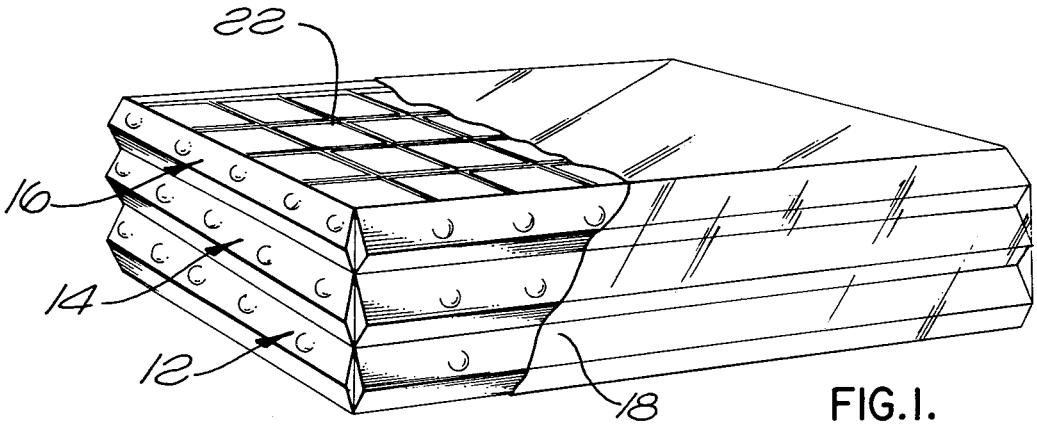
FIG.1.
FIG.2.
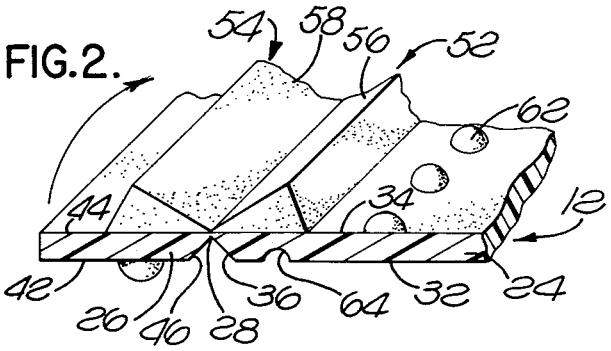
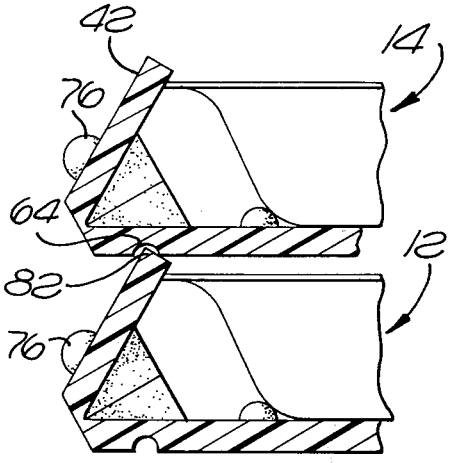
FIG.5.
FIG.3.
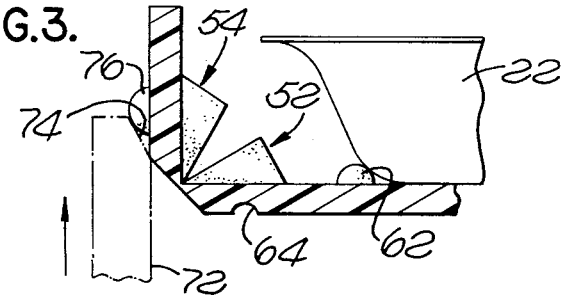
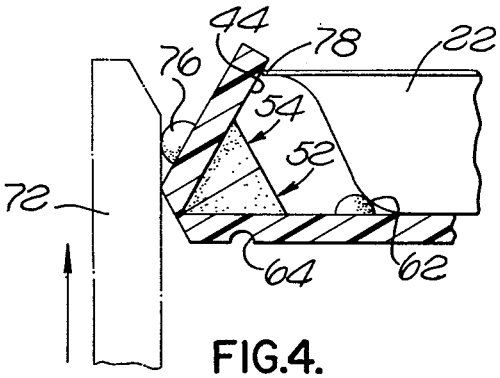
FIG.4.
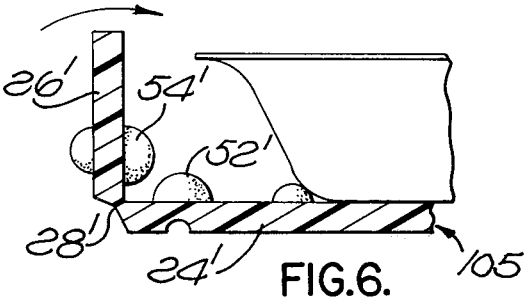
FIG.6.
FIG.7.
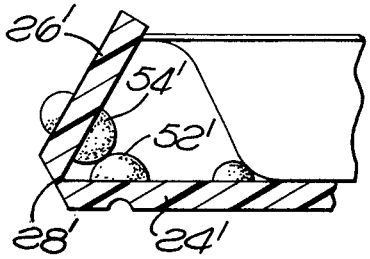

CONTAINER CONSTRUCTION

This is a continuation of application Ser. No. 434,179, filed Jan. 17, 1974 now abandoned.

FIELD OF THE INVENTION

The field of art to which the invention pertains includes the field of packaging and container particularly such structures as can be set up from flat unassembled form.

BACKGROUND AND SUMMARY OF THE INVENTION

Conventional packages or containers which are utilized to secure a plurality of separable items are typically hand assembled or are stored in their final, bulky configuration. Hand assembly significantly increases the net cost of the goods being packaged. Automatic closing systems are used, but the complexity of the mechanism used requires higher capital investments and frequent maintenance. Furthermore, most automatic closure systems utilize containers which completely enclose the contents and do not permit the design characteristics of the enclosed items to be displayed. It would be desirable to provide a container construction which is easily loaded, easily and automatically closable and which permits the design characteristics of the packaged units to be seen.

The present invention provides a container which satisfies the foregoing needs. The container can be stored in a planar configuration and stacked with similar containers in a minimum of space until ready for use and then can be automatically assembled to its final configuration. After assembly, the packed containers can be stacked by an interlocking arrangement. The stacked and interlocked containers can then be wrapped for use as a display.

Each container comprises a bottom wall defining a floor of generally planar configuration and a plurality of side walls, each formed in a plane parallel to the floor when the container is stored prior to use. The side walls are flexibly connected to the bottom wall so as to define hinge lines around the perimeters and the bottom wall. Shoulders are formed on the wall surfaces adjacent the hinge line, placing the side members at a predetermined angle with respect to the floor and serving to define chosen limits for the side walls when the container is assembled. Automatic closure is facilitated by the foregoing closure limits and by external protuberances on the side walls which react against simple vertical movement of a closure plate. Channels are provided on the bottom surface of the bottom wall to permit aligned stacking of the containers.

The advantages of the invention, both as to its construction and mode of operation, will be readily appreciated as the same becomes better understood by reference to the following detailed description when considered in connection with the accompanying drawings, in which like reference numerals designated like parts throughout the figures.

BRIEF DESCRIPTION OF THE DRAWINGS

FIG. 1 is a perspective view partially broken away of a plurality of containers in an assembled configuration.

FIG. 2 is a partial cross-sectional view of one of the containers in an unassembled configuration;

FIG. 3 is a partial cross-sectional view of the container of FIG. 2 illustrating a technique for assembly of the container;

FIG. 4 is a partial cross-sectional view of the container of FIG. 2 when fully assembled;

FIG. 5 is a partial cross-sectional view of a plurality of assembled containers illustrating aligned stacking thereof;

FIG. 6 is a cross-sectional view illustrating an alternative embodiment of a partially assembled container;

FIG. 7 is a cross-sectional view of the container of FIG. 6 when assembled.

DECRIPTION OF THE PREFERRED EMBODIMENT

Referring now to the drawings, there is shown in FIG. 1, a plurality of containers 12, 14, and 16 illustrated in a stacked arrangement and constructed in accordance with principles of the invention. A wrapping member 18, such as polyethelene shrink film, illustrated partially broken away, is utilized to encase the stacked arrangement of containers enabling the goods or items in the top container to be viewed. In the illustration, the items 22, which are placed in the packaging device, are individual serving packages, such as packages of marmalade as served in restaurants. As a result of the present packaging arrangement a pleasant design is created displaying, in repetition, the design of the top surfaces of the individual items 22. It should be understood that other items could be packaged in the containers 12, 14, and 16 or an individual item could be secured in each container.

Referring now to FIG. 2, there is illustrated a portion of one of the containers 12 of FIG. 1, in an unassembled form. The container 12 is shown in a planar configuration and includes a bottom wall, defining a floor surface 34 and a bottom surface 32, and an adjacent side wall 26 joined to the floor surface 22 at a hinge line 28. There are four such side walls, each joined by a hinge line to an edge of the floor surface 24. To define the hinge line 28, the bottom surface 32 tapers toward the floor surface 34 at an edge 36 and, similarly, the outer surface 42 of the side wall 26 tapers toward the inner surface 44 thereof at an edge 46. The hinge line 28 is thus defined by a minimum thickness of material, enabling the side walls to be readily folded upwardly for assembly.

Shoulders 52 and 54, each of triangular cross-section are formed with their apices contiguous to opposite sides of the hinge line 28. The confronting surfaces 56 and 58 of the shoulders 52 and 54, respectively, are formed at a predetermined slope so that when the side wall 26 is folded as shown by the arrow in FIG. 2, the abutment of the surfaces 56 and 58 limit the closure of the side walls, i.e. they determine the final position and angle of the side walls 26 with respect to the floor surface 24.

Each edge of the bottom wall 24 is similarly joined to a side wall with shoulder similarly arranged. The ends of the shoulders are, of course, chamfered upwardly from the corners of the bottom wall sufficiently to permit the shoulder to meet at the corners.

A plurality of protuberances 62 are formed on the floor surface 34 and are utilized to position items such as the items 22 illustrated in FIG. 1 and shown in greater detail in FIG. 3. A channel 64, which extends along the axis of the hinge line 28 but is spaced therefrom is formed on the bottom surface 32 of the bottom wall 24. The channel 64 enables assembled packages to be stacked in the manner shown in FIG. 1 as will be explained hereinafter.

To mechanically assemble the packaging devices in the manner shown in FIG. 1, a closure plate 72, shown in dotted lines in FIG. 3, can be utilized. The plate 72 is generally rectangular in configuration but contains a beveled edge 74. When the plate 72 is moved vertically, as shown by the arrow in FIG. 2, it abuts the outer surface 42 of the side wall 26. Continued movement upwardly of the plate 72 causes the beveled surface to push against protuberances 76 formed on the outer surface 42 of the side wall 26. The protuberances 76 provide reaction surfaces for the closure plate 72 and also serves as cushions so as to minimize damage by the plate 72 to the container during the automatic or semi-automatic assembly. The side wall 26 is thus pushed upwardly until in a plane perpendicular to the floor surface 24, as illustrated in FIG. 3. As the tool continues to move upwardly against the protuberances 76, the side wall 26 folds so as to form an acute angle with respect to the floor surface 24 limited by abutment of the shoulders 56 and 58. Thus, the final angle at which the side wall comes to a rest is determined by the slope of the adjacent surfaces 56 and 58 of the shoulders 52 and 54, respectively, as illustrated in FIG. 4. These slopes are chosen so that the inner surface 44 of the side wall 26 will abut the item 22 at its outer edge surface 78. The item 22 is thus positioned in the packaging device 12 prior to assembly thereof, and with a minimum of movement of the item.

Referring now to FIG. 5 there is shown a technique of stacking a plurality of containers 12 and 14 of FIG. 1. The outer free corner edge of the side wall 26 is positioned in the channel 644 formed in the bottom surface 32 of the bottom wall 24. The slope of the side wall 26 is defined by the abutment of the shoulders 52 and 56. For automatic assembly, it is desirable that the angle of the slope of the side wall 26 be as close to 90° as possible while low enough to permit placement of the side wall corner edge 82 into the channel 64 of an adjacently stacked container. The angle chosen depends on the minimum spacing of the channels 64 from the edges of the bottom wall 24 as is permissible for the material used. The present containers are constructed of foamed polystyrene and a slope angle of about 65° is satisfactory.

The surfaces 56 and 58 of the shoulders 52 and 54 respectively, can be precoated with a self sticking adhesive so that when the side walls are raised they tend to remain in the raised position. As a result of the stacking feature and alignment provided by the channel 64, the durability of the adhesive need not be great but only sufficient to secure the side walls until a succeeding container is placed thereon. Thereafter, the next container is placed on top of the first container and, after loading, its side walls are raised, and so on, until the desired number of stacked containers is achieved. Thereafter, the assembly is secured together by wrapping in polyethelene shrink film. In such secured disposition, the adhesive, if not of a quick hold type, sets to form a tight bond so that when the final user opens the packages the side walls will not fall away.

Referring now to FIGS. 6 and 7, there is shown an alternative shoulder configuration. In the arrangement of FIG. 6, in place of triangular shoulders, a plurality of protuberances 52′ are formed spaced along the floor surface of the bottom wall floor portion 24′, extending along the hinge line 28′ thereof. Similarly, protuberances 54′ are spaced along the inner surface of the side wall 26′ adjacent the hinge line 28′ and opposite the protuberances 52′. Assembly of the packaging device of FIGS. 6 and 7 is similar to that of FIGS. 2–5. The angle between the side wall 26′ and the bottom wall 24′ is determined by the size of each of the protuberances 52′ and 54′. The protuberances 52′ and 54′ are hemi-spherical and the angle is determined by their radii. Self-sticking adhesive can be used to coat the protuberances 52′ and 54′ as described above with respect to the embodiment of FIG. 2–5.

I claim:

1. A tray-like container formed of foamed polystyrene, which can be stacked with unassembled in a generally planar configuration prior to use, comprising:

a bottom wall of generally planar configuration having a bottom surface and a floor surface upon which items to be packaged can be placed;

a plurality of side walls surrounding said bottom wall each being formed so as to lie in a plane parallel to said floor surface when open, each of said side walls being contiguously connected to one edge of said floor surface of said bottom wall by hinge lines therebetween and having an upward extent substantially smaller then the smallest lateral extent of said bottom wall;

abutment means formed on said container adjacent said hinge lines positioning said side walls over said bottom wall at a predetermined acute angle with respect to said floor surface and disposing free outer corner edges of said side walls in a single plane; and plastic film shrunk-fit across the top of said container enclosing articles therein and forming a planar sheet across said free outer corner edges of said side walls.

2. A packaging device in accordance with claim 1 wherein said abutment means comprises shoulder members formed on confronting sides of said hinge lines, on said side walls and on said floor surface, said shoulder members interacting to define the angle of said side walls with respect to said floor surface.

3. A packaging member in accordance with claim 2 wherein said shoulder members extend along the length of respective ones of said hinge lines.

4. A packaging device in accordance with claim 2 wherein said shoulder members are formed of a plurality of curved members spaced along the length of respective ones of said hinge lines.

5. A packaging device in accordance with claim 3 wherein said shoulder members are triangular in cross-sectional configuration, the apices thereof being contiguous to opposite sides of respective ones of said hinge lines.

6. A packaging device in accordance with claim 1 and further comprising protuberances formed on the floor surface of said bottom wall, said protuberances acting to correctly align items placed on the top surface of said container.

7. A packaging device in accordance with claim 1 further comprising channels formed into said bottom surface of said bottom wall spaced inwardly from each side member so as to enable said outer free corner edges of the side walls of a lower adjacent container of like construction to be inserted therein to allow stacking of a plurality of assembled containers.

8. A plurality of containers as defined in claim 7 aligned and stacked one on the other and enclosed by said plastic film.

9. A packaging device in accordance with claim 1 further comprising protuberances formed on the bottom surfaces of said side walls for providing reaction surfaces to facilitate closure to said acute angle.

* * * * *

UNITED STATES PATENT AND TRADEMARK OFFICE

CERTIFICATE OF CORRECTION

PATENT NO. : 4,046,256
DATED : September 6, 1977
INVENTOR(S) : WAYNE L. CONGLETON It is certified that error appears in the above-identified patent and that said Letters Patent are hereby corrected as shown below:

Col. 3, line 32, "644" should be --64--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*